US006079186A

United States Patent [19]

Simon et al.

[11] Patent Number: 6,079,186

[45] Date of Patent: Jun. 27, 2000

[54] METHOD OF MAKING VACUUM-PACKAGED, CAPACITOR-GRADE TANTALUM POWDER

[75] Inventors: Ross W. Simon, Medfield, Mass.; Katsuo Iwabuchi; Hirobumi Ishikawa, both of Naka-Gun, Japan; Dieter Behrens, Im Schleeke, Germany

[73] Assignee: H.C. Starck, Inc., Newton, Mass.

[21] Appl. No.: 08/472,596

[22] Filed: Jun. 7, 1995

[51] Int. Cl.[7] ..... B65B 31/02

[52] U.S. Cl. ..... 53/432

[58] Field of Search ..... 53/432, 510; 29/25.03, 29/25.02; 361/529, 509

[56] References Cited

U.S. PATENT DOCUMENTS

| | | | |
|---|---|---|---|
| 4,296,588 | 10/1981 | Vetter | 53/510 |
| 4,480,747 | 11/1984 | Kazor et al. | 206/721 |
| 4,677,809 | 7/1987 | Long et al. | 53/427 |
| 4,966,280 | 10/1990 | Bradford | 206/721 |
| 5,155,969 | 10/1992 | Kuethe | 53/510 |
| 5,228,270 | 7/1993 | Aarts | 53/510 |
| 5,470,525 | 11/1995 | Tripp et al. | 419/36 |
| 5,560,182 | 10/1996 | Garwood | 53/432 |
| 5,577,368 | 11/1996 | Hamilton et al. | 53/432 |
| 5,605,561 | 2/1997 | Iwabuchi et al. | 75/364 |

OTHER PUBLICATIONS

Metals Handbook, 9th Edition; American Society for Metals, Metals Park, OH 44073; vol. 7, 1984.

*Primary Examiner*—Stephen F. Gerrity
*Assistant Examiner*—John Paradiso
*Attorney, Agent, or Firm*—Jerry Cohen

[57] ABSTRACT

The performance of capacitor-grade tantalum powder that is vacuum packaged is enhanced. Preventing contact with air reduces the quantity of oxygen that passes through the oxide film and dissolves in the substrate. Lower oxygen in the powder can lower DC leakage in the capacitor made from the powder. Over a 4-month period, vacuum/argon packaging reduces oxygen pick-up in a 50K-class powder by over 200 ppm compared with the same powder stored in conventional packaging.

1 Claim, 3 Drawing Sheets

METHOD OF MAKING VACUUM-PACKAGED, CAPACITOR-GRADE TANTALUM POWDER

FIELD OF THE INVENTION

The present application relates to the vacuum packaging of capacitor-grade tantalum powder.

BACKGROUND OF THE INVENTION

Electrostatic discharge will ignite finely dispersed tantalum powder. To improve safety when working with tantalum powder, the user therefore should seek to reduce the risk of electrostatic sparking. One common generator of high electrostatic potential is plain plastic. For example, using ungrounded sections of plastic hose in a dust collection system can generate enough electrostatic charge and subsequent sparking to ignite the tantalum powder contained therein, potentially resulting in a dangerous explosion. Likewise, use of packaging materials that do not produce electrostatic charge will improve the safety of handling high-surface area tantalum powder.

Reference is made in the literature to extraction of oxygen from the dielectric oxide by the tantalum substrate at temperatures in excess of 200° C. Smyth, D. M., Shirn, G. A., and Tripp, T. B., "Heat Treatment of Anodic Oxide Films on Tantalum", 110:12 J. Electrochem. Soc'y (1963). However, Applicant is unaware of any reference suggesting that significant reductions in oxygen pick-up during powder storage may be achieved by packaging under vacuum and/or argon blanket conditions, as presently claimed.

Accordingly, it is an object of the invention to provide packaging conditions that reduce the quantity of oxygen that passes through the oxide film.

It is a further object of the invention to improve the performance of capacitor-grade tantalum powder by reducing the quantity of oxygen dissolved in the substrate.

It is another object of the invention to improve the safety of storing and handling capacitor-grade tantalum powder by reducing the electrostatic charge allowed to build-up.

It is a still further object of the invention to provide superior capacitors made from tantalum powder packaged and stored under vacuum and/or argon blanket conditions.

SUMMARY OF THE INVENTION

The foregoing objects are achieved in a process in which the traditional packaging environment is replaced by a vacuum and/or under an argon blanket. Preventing contact with air reduces the quantity of oxygen adsorbed onto the surface of the powder. Lower oxygen in the powder results in lower DC leakage in the capacitor made from the powder. Current testwork with 50K-class powder demonstrates that over a 3-month period, vacuum/Ar packaging reduces oxygen pick-up by approximately 200 ppm.

Contemplated standard vacuum packaging materials provide an oxygen transmission rate from about 0.045 cc/100 $in^2$/day to about 1.0 cc/100 $in^2$/day. The oxygen transmission rate may be reduced to about 0.0 cc/$m^3$/day by use of metallized plastic. A further benefit of using metallized plastic packaging material is that it generates no electrostatic charge, as measured with an ACL Model 300B Electrostatic Locator. In contrast, plastic bottles, nylon bags, and other conventional packaging materials may generate over 5000 V apparent charge.

In addition to minimizing oxygen contamination while in storage and reducing the dangers posed by electrostatic discharge, vacuum packaging enhances certain physical properties of the powder. The filled and sealed package firmly yet gently retains the powder so that particles cannot move relative to each other. Thus, segregation and possibly attrition due to vibration during shipping and storage is arrested. Further, the economic cost of vacuum packaging material is significantly less than conventional storage media, resulting in considerable dollar savings.

BRIEF DESCRIPTION OF PREFERRED EMBODIMENTS

The practice of the invention according to preferred embodiments thereof is indicated by the following non-limiting examples.

EXAMPLE 1

Figure 1:
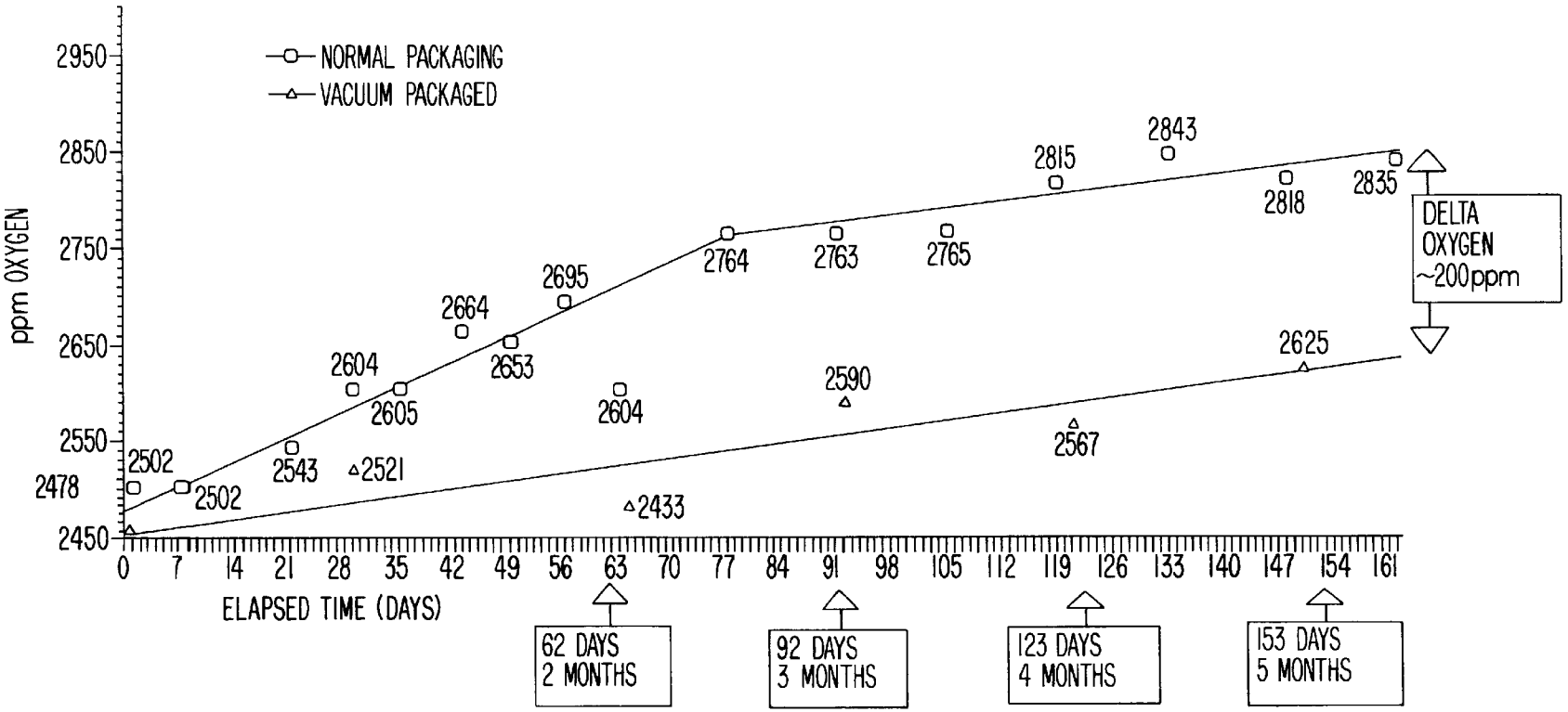
FIG. 1 shows a comparison in oxygen pick-up over a five-month period between conventionally packaged and vacuum-packaged tantalum powder.

Eight packages each containing 0.25 lbs of NA50K Blend. 18 tantalum powder was packaged immediately upon completion of the manufacturing cycle. As a control, one 0.5 lb sample of the same batch of NA50K Blend. 18 powder was placed in a conventional plastic bottle. Oxygen content was monitored in powder samples immediately upon opening each vacuum-packed pouch. Similar measurements were taken from the conventionally packaged control sample at the same times. The results of this experiment are shown in FIG. 1. The data show that, over a four-month trial period, oxygen pick-up was 200 ppm less for the vacuum-packed powder sample than in the control sample.

EXAMPLE 2

Figure 2:
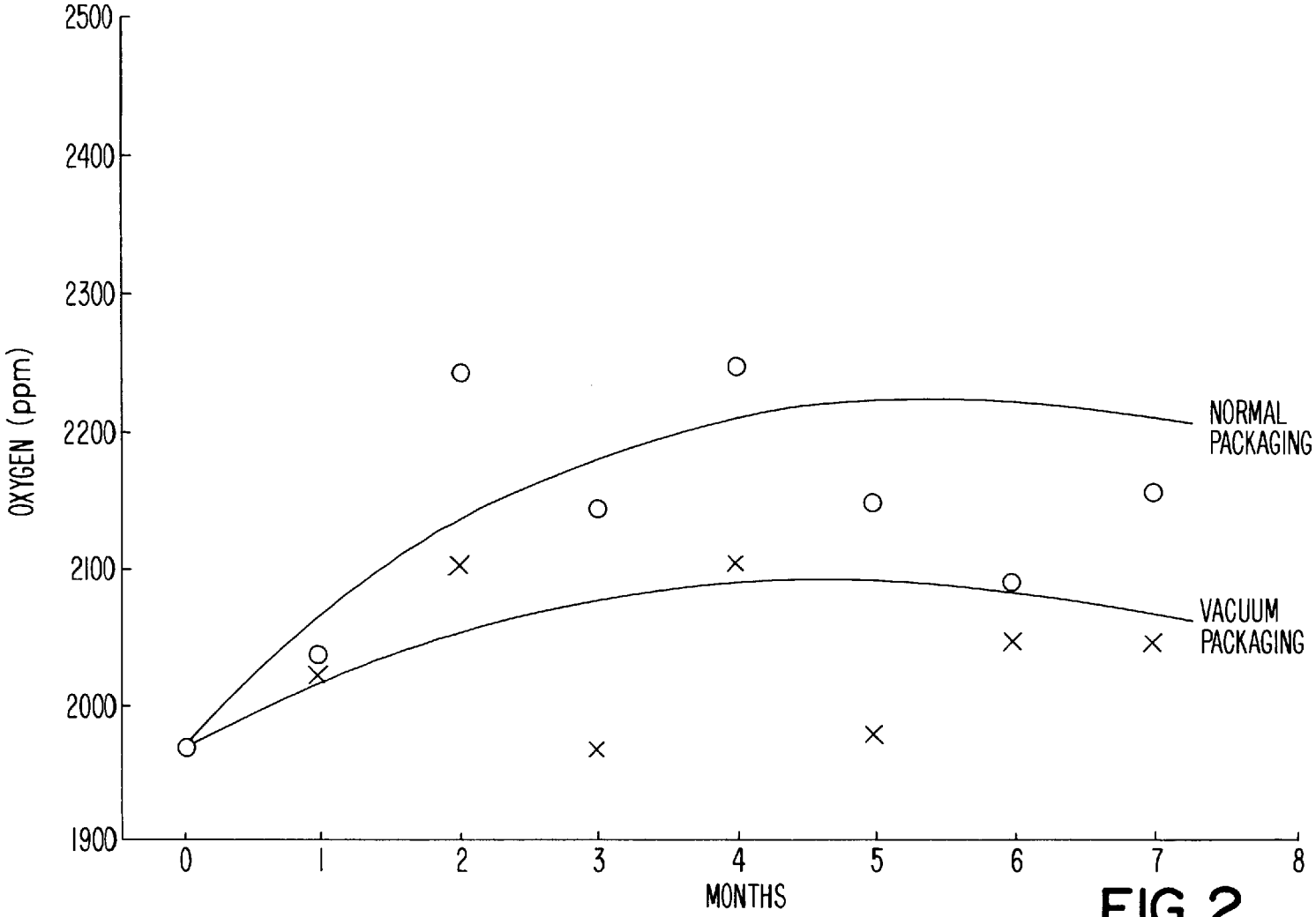
FIG. 2 shows a comparison in oxygen pick-up over a seven-month period between conventionally packaged and vacuum-packaged tantalum powder.
Figure 3:
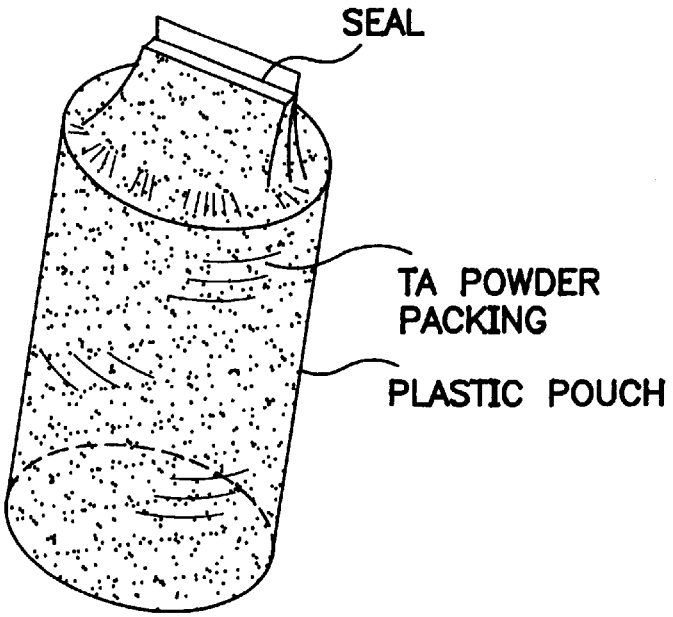
FIG. 3 shows the packaged product.
Figure 4:
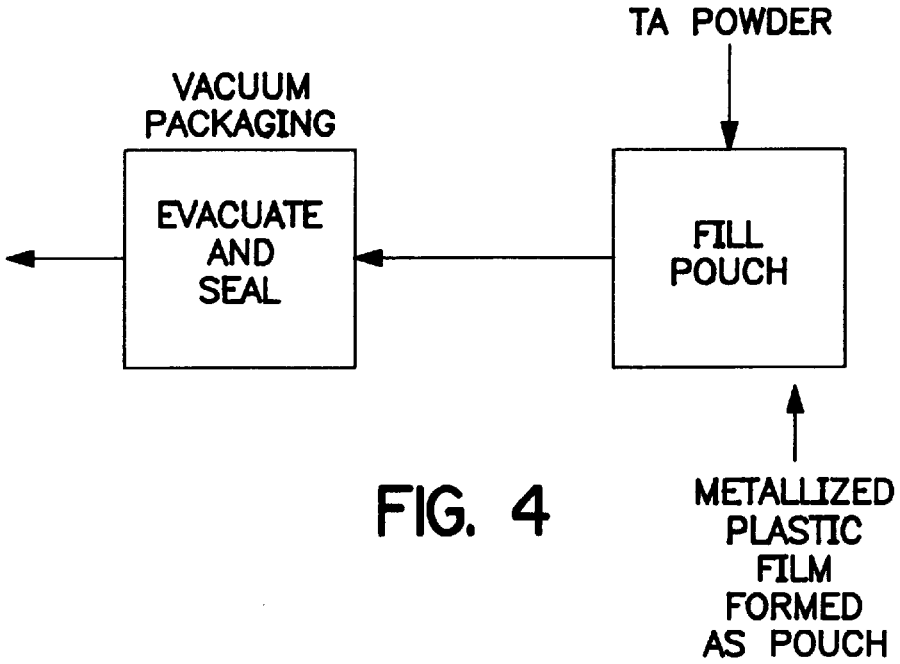
FIG. 4 is a block diagram of the process steps of the invention.

2.0 kg samples of tantalum powder were packaged under vacuum conditions (about 0.7 bar) immediately upon the termination of the manufacturing process and stored for seven months. A control sample was contemporaneously packaged using conventional packaging technology. As shown in FIG. 2, oxygen pick-up over a seven-month period was reduced by up to 150 ppm without changing the physical characteristics of the powder.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A process of packaging high capacitance capacitor grade tantalum powder of submicron size, comprising the steps of:

a) placing a sub-micron tantalum powder in a packaging apparatus capable of generating a vacuum condition;

b) generating a vacuum condition in a region;

c) providing a package in the region made of a material with non-electrostatic properties and with oxygen transmission rates of about 0.045 cc/100 $in^2$/day to about 1.0 cc/100 $in^2$/day; and d) pouring the powder into said package and sealing it while under the vacuum condition.

* * * * *